US005711279A

United States Patent [19]

Green et al.

[11] Patent Number: 5,711,279

[45] Date of Patent: Jan. 27, 1998

[54] FUEL SYSTEM

[75] Inventors: Alan Conway Green, Maidstone; John William Stevens, Gillingham, both of United Kingdom

[73] Assignee: Lucas Industries, PLC, England

[21] Appl. No.: 595,871

[22] Filed: Feb. 6, 1996

[30] Foreign Application Priority Data

Feb. 11, 1995 [GB] United Kingdom ..... 9502671

[51] Int. Cl.[6] ..... F02M 41/00; F02M 41/16

[52] U.S. Cl. ..... 123/506; 123/467; 239/96

[58] Field of Search ..... 123/446, 447, 123/467, 506, 510, 511, 501, 503; 239/96

[56] References Cited

U.S. PATENT DOCUMENTS

| | | | |
|---|---|---|---|
| 4,475,515 | 10/1984 | Mowbray | 123/467 |
| 4,784,101 | 11/1988 | Iwanaga et al. | 123/506 |
| 5,176,120 | 1/1993 | Takahashi | 123/467 |
| 5,333,588 | 8/1994 | Cananagh | 123/506 |
| 5,441,029 | 8/1995 | Hlousek | 123/467 |
| 5,443,047 | 8/1995 | Ishiwata et al. | 123/506 |
| 5,522,364 | 6/1996 | Knight et al. | 123/506 |

FOREIGN PATENT DOCUMENTS

| | | |
|---|---|---|
| 0582993 | 2/1994 | European Pat. Off. . |
| 4115477 | 11/1991 | Germany . |
| 4118236 | 12/1991 | Germany . |

OTHER PUBLICATIONS

Patent Abstracts of Japan, vol. 15, No. 25 (M-1071), 21 Jan. 1991 & JP-A-02 267363 (Nippondenso), 1 Nov. 1990.

*Primary Examiner*—Thomas N. Moulis

*Attorney, Agent, or Firm*—Andrus, Sceales, Starke & Sawall

[57] ABSTRACT

A fuel system is disclosed which comprises a fuel pump, a spill valve and an injector provided in a single unit. The injector includes a valve member biased towards a seating by a coiled compression spring. The spring is engaged between a spring abutment of the valve member and a piston. The piston is arranged such that the face thereof facing away from the spring has fuel applied thereto when the spill valve is opened in order to assist movement of the valve member into engagement with the seating.

9 Claims, 2 Drawing Sheets

FUEL SYSTEM

BACKGROUND OF THE INVENTION

This invention relates to a fuel injection system for supplying fuel to an internal combustion engine and of the kind comprising a cam actuated plunger pump having a pump chamber, an outlet from said pump chamber, a fuel injection nozzle connected to said outlet, said nozzle having a fuel pressure actuated valve member which is resiliently biased to a closed position in which it is in engagement with a seating, and which is opened to allow fuel flow through a nozzle outlet when the fuel pressure in the pump chamber attains a sufficiently high value, and a spill valve operable to spill fuel from said pump chamber thereby lowering the pressure therein and allowing closure of the valve member to prevent further flow of fuel through said outlet.

An example of such a system is a so called unit/injector in which the pump, the nozzle and the spill valve are constructed as a single unit. This enables very high fuel pressures to be developed which are advantageous for the reduction of exhaust emissions from the associated engine. However, such advantages can be lost if the valve member does not close onto its seating quickly when the spill valve opens to lower the fuel pressure in the pumping chamber.

It has been proposed to direct the fuel which is spilled, onto a surface of the valve member to assist the closure of the valve member by the resilient means. An example of such an arrangement is seen in U.S. Pat. No. 4,475,515. The area of the end of the valve member is fixed by other design constraints such as the performance during the opening of the valve member and space considerations. As a result the pressure in the spring chamber must be quite high to achieve any improvement in the valve closing characteristics.

SUMMARY OF THE INVENTION

According to the invention in a system of the kind specified said resilient means comprises a coiled compression spring one end of which engages an abutment movable to compress the spring as the valve member is moved away from the seating, the other end of the spring engaging a piston which is slidable in a bore, the end face of the piston remote from the spring when the spill valve is opened, being subjected to the pressure of the fuel flowing through the spill valve thereby to displace the piston to facilitate closure of the valve member onto its seating.

BRIEF DESCRIPTION OF THE DRAWINGS

Examples of fuel systems in accordance with the invention will now be described with reference to the accompanying drawings in which.

DETAILED DESCRIPTION

Figure 1:
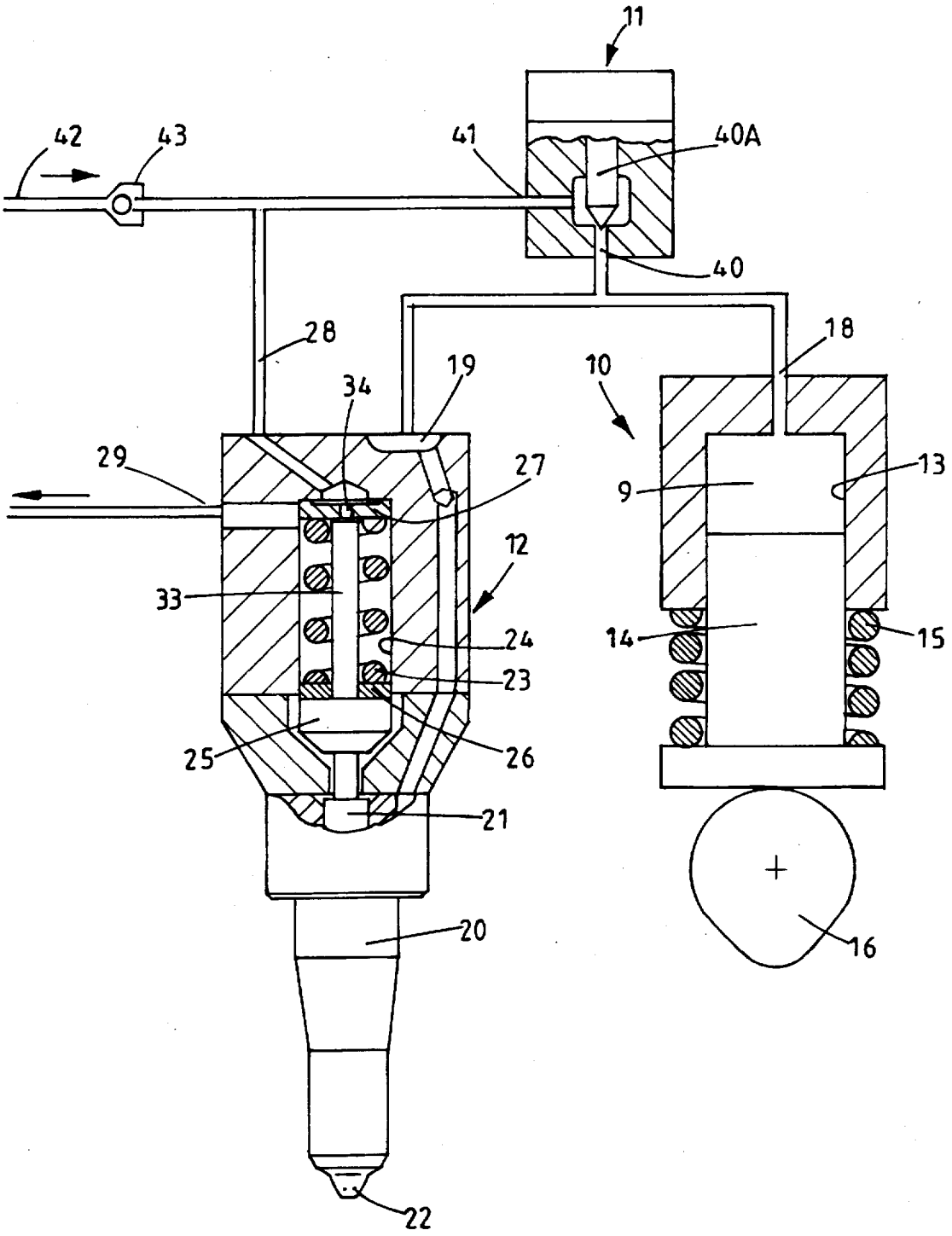
FIG. 1 is a diagrammatic representation of one example of the system.

Referring to FIG. 1 of the drawings the fuel system comprises a cam actuated reciprocable plunger pump 10, a spill valve 11 and a fuel injection nozzle 12. In a practical arrangement these three components are mounted on a common body.

The plunger pump comprises a cylindrical bore 13 in which is slidably mounted a pumping plunger 14. The plunger is biased outwardly of the bore by means of a coiled compression spring 15 and is movable inwardly by an engine driven cam 16. As shown the cam 16 operates directly upon the plunger but in practice a tappet assembly will be provided and the plunger may be actuated through a rocker arm. The inner end of the bore together with the end of the pumping plunger constitute a pump chamber 9 having an outlet 18 which is connected to an inlet 19 of the fuel injection nozzle 12.

The fuel injection nozzle includes a nozzle body 20 housing an inwardly opening valve member 21. The valve member is urged into engagement with a seating to prevent fuel flow from the inlet 19 to an outlet 22 or a plurality of outlets, by means of a coiled compression spring 23 housed within a chamber which is defined by the blind end of a bore 24. The valve member 21 carries a spring abutment 25 which is engaged with one end of the coiled compression spring 23 through the intermediary of a shim 26 and the opposite end of the spring engages a disc like piston 27 which is slidable in the bore and is engageable with the blind end of the bore. Piston 27 is provided with a central orifice 34 and the bore 24, adjacent its blind end is provided with an outlet 29. The spring abutment 25 carries a spindle 33 which extends into close proximity to the piston but is separated therefrom by a distance equal to the required total lift of the valve member. The spindle may be integral with the abutment or may be a separate part. As is the usual practice, the valve member defines an area against which the fuel under pressure at the inlet 19 can act to lift the valve member away from the seating against the action of the spring. In this example the extent of movement of the valve member away from its seating is limited by the engagement of the spindle with the piston 27.

The spill valve 11 has an inlet 40 which is connected to the pump chamber and an outlet 41 which is connected through a passage 28 to the blind end of the bore 24. The spill valve is conveniently electromagnetically operated by an actuator, under the control of an electronic engine control system and includes a valve member 40A which is spring biased to the open position. The actuator includes a solenoid and an armature which is coupled to the valve member 40A and when the solenoid is energised the armature moves the valve member into engagement with a seating to close the valve.

In operation, fuel is drawn into the pumping chamber 9 on the outward stroke of the pumping plunger 14 via an inlet port 42, a non-return valve 43, through the open spill valve 11 and the outlet 18. Then starting from the position of the cam 16 shown in FIG. 1, as the cam rotates and the follower engages the leading flank of the cam lobe, inward movement will be imparted to the plunger 14. Such movement will displace fuel through the outlet 18 and initially the fuel will pass through the open spill valve 11 and flow via passage 28 and orifice 34 to the outlet 29. When injection is required the spill valve is closed and the fuel in the pumping chamber 9 will be pressurised and will flow to the fuel injection nozzle via port 19. When the pressure attains a predetermined value, the valve member 21 of the nozzle will be lifted from its seating to allow fuel flow through the outlet 22. This flow of fuel will continue so long as the pumping plunger is being moved inwardly by the cam, until the spill valve 11 is opened. The lift of the valve member 21 will be limited by the engagement of the spindle with the piston which will also effect closure of the orifice 34.

When the spill valve is opened fuel under pressure flows to the inner end of the bore 24 where it is arrested by the closed orifice 34. This will effect displacement of the piston 27, spindle 33 and the spring abutment to assist closure of the valve member. Displacement of the piston will allow the split fuel to escape through the outlet 29 to drain. As a result the pressure of fuel in the pump chamber 9 falls so that the force acting to maintain the valve member 21 of the nozzle in the open position is reduced. This reduction of force combined with the force acting on piston 27, results in rapid closure of the valve member 21 onto its seating and therefore rapid termination of fuel flow through the outlet 22. The piston 27 is then returned into engagement with the end of the bore by the action of the spring.

Figure 2:
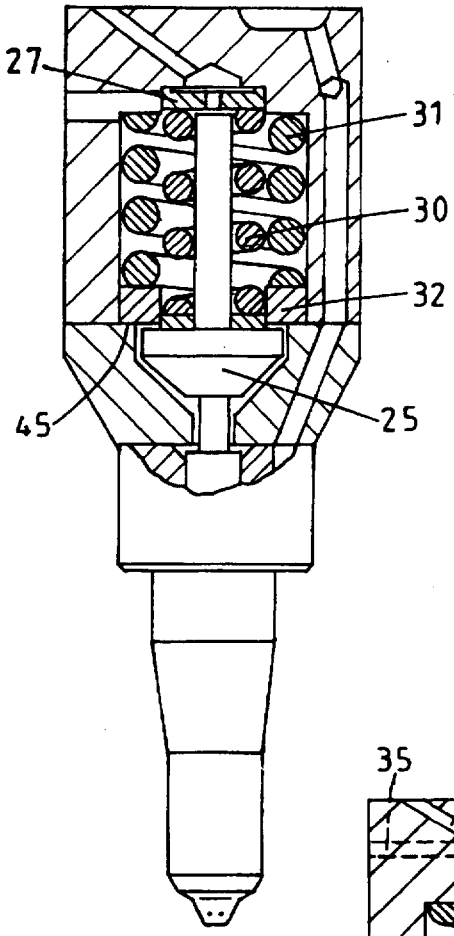
FIGS. 2, 3 and 4 show modifications to part of the system which is shown in FIG. 1.

Referring now to FIG. 2 there is shown therein a so called two stage lift injection nozzle with the spring abutment 25 engaging with one end of a coiled compression spring 30 which biases the valve member to the closed position. A second coiled compression spring 31 is provided which engages a step in the spring chamber at one end and with a movable abutment ring 32 at its other end. The ring 32 is biased into engagement with a step 45 defined at the outer end of the chamber which contains the springs. The spring abutment 25 is positioned to engage with the abutment ring after a predetermined movement of the valve member away from its seating. In operation therefore and with the spill valve closed, the fuel pressure in the pump chamber increases and when it reaches a level determined by the force exerted by the spring 30, the valve member is lifted from its seating to allow a restricted flow of fuel through the outlet or outlets 22. As the fuel pressure in the pump chamber increases the force exerted on the valve member by the fluid pressure eventually overcomes the action of both springs and the valve member moves to its fully open position. As with the arrangement shown in FIG. 1, the piston 27 will be urged by the pressure of the spilled fuel when the spill valve 11 is opened, to exert a closing force upon the valve member to effect rapid movement of the valve member into engagement with the seating.

Figure 3:
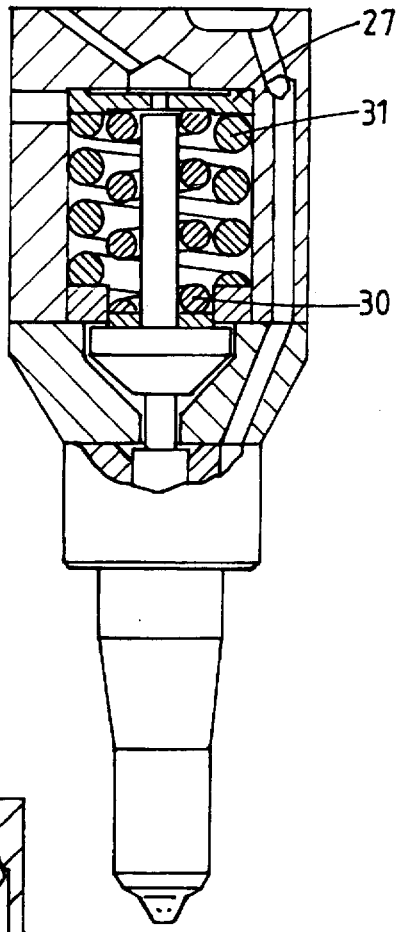

FIG. 3 shows a modification to the arrangement shown in FIG. 2 in as much as piston 27 is of a larger diameter and is engaged by both springs 30 and 31. This arrangement will operate in a similar fashion to the scheme shown in FIG. 2. However, in this case when the spill valve is opened the fuel under pressure entering the blind end of the spring chamber is now acts over a larger area of piston. This will result in a greater force to assist in the closure of the valve member 21. The effective area over which the spilled fuel acts on the pistons, in all arrangements, can be chosen to adjust the closing forces acting on the valve member 21 to give closing characteristics optimised for performance and the life of the nozzle seating.

Figure 4:
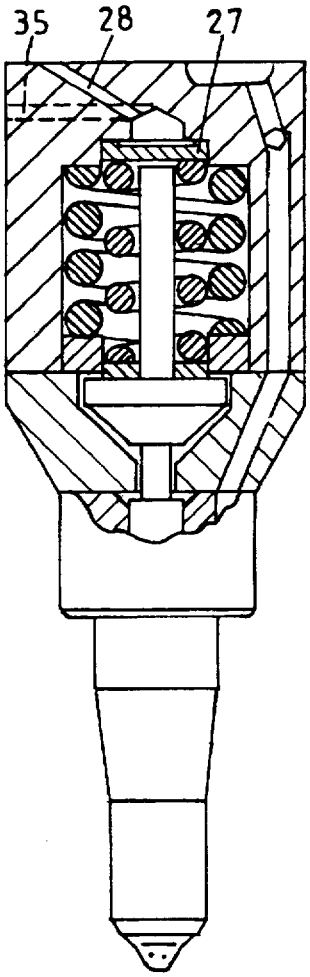

The arrangement shown in FIG. 4 is substantially the same as that which is shown in FIG. 2 except that the piston is not provided with the orifice 34 and the outlet 29 through which fuel escapes from the spring chamber, is omitted. In its place there is a branch passage 35 which extends from the passage 28. The effective sizes of the passage 35 and the passage 26 can be chosen to vary the assistance provided by movement of the piston when the spill valve is opened. This arrangement can also be applied to the arrangement incorporating the larger piston as shown in FIG. 3.

We claim:

1. A fuel injection system for supplying fuel to an internal combustion engine comprising a cam actuated plunger pump having a pump chamber, an outlet from the pump chamber, a fuel injection nozzle, the nozzle having a fuel pressure actuated valve member, means arranged to resiliently bias the valve member to a closed position in which it is in engagement with a seating, the valve member being arranged to be lifted from the seating to allow fuel flow through a nozzle outlet when the fuel pressure within the pump chamber attains a sufficiently high value and a spill valve operable to spill fuel from the pump chamber thereby lowering the pressure therein and allowing closure of the valve member of the nozzle to prevent further flow of fuel through said outlet, wherein said resilient means comprises a coiled compression spring one end of which engages an abutment movable to compress the spring as the valve member is moved away from the seating, the other end of the spring engaging a piston slidable in a bore, the end face of the piston remote from the spring, when the spill valve is opened, being subjected to the pressure of fuel flowing through the spill valve thereby to displace the piston to facilitate closure of the valve member onto its seating.

2. A fuel injection system as claimed in claim 1, wherein the valve member is provided with an extension arranged to engage the piston when the valve member occupies a fully open position.

3. A fuel injection system as claimed in claim 1, wherein the piston is provided with an orifice extending therethrough to permit fuel to flow to a spring chamber, the spring chamber communicating with an outlet.

4. A fuel injection system as claimed in claim 2, wherein the piston is provided with an orifice extending therethrough to permit fuel to flow to a spring chamber, the spring chamber communicating with an outlet.

5. A fuel injection system as claimed in claim 4, wherein the orifice is located such that when the valve member occupies its fully open position, the extension closes the orifice.

6. A fuel injection system as claimed in claim 1, further comprising second resilient means, the valve member being movable against the action of the second resilient means when the valve member is lifted from its seating by a distance exceeding a predetermined distance.

7. A fuel injection system as claimed in claim 6, wherein the second resilient means comprises a second coiled compression spring arranged to engage an abutment, the abutment being arranged to engage the abutment of the valve member when the valve member is lifted from the seating by a distance exceeding the predetermined distance.

8. A fuel injection system as claimed in claim 6, wherein the second resilient means engages the piston.

9. A fuel injection system as claimed in claim 1, wherein the pump chamber is arranged to be supplied with fuel through the spill valve.

* * * * *